US007441918B2

(12) United States Patent
Kim

(10) Patent No.: US 7,441,918 B2
(45) **Date of Patent: *Oct. 28, 2008**

(54) SWITCHES FOR ELECTRICAL ACCESSORIES

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/820,805

(22) Filed: Jun. 20, 2007

(65) Prior Publication Data

US 2007/0253189 A1 Nov. 1, 2007

Related U.S. Application Data

(62) Division of application No. 10/835,960, filed on Apr. 29, 2004, now Pat. No. 7,273,292.

(51) Int. Cl.
*F41G 1/34* (2006.01)
*H01H 9/00* (2006.01)

(52) U.S. Cl. ..... 362/114; 362/110; 200/18

(58) Field of Classification Search ..... 362/110, 362/114; 200/18; 42/146, 132
See application file for complete search history.

(56) References Cited

U.S. PATENT DOCUMENTS

| | | | |
|---|---|---|---|
| 2,436,453 | A | 2/1948 | Schulz |
| 4,319,106 | A | 3/1982 | Armitage |
| 4,532,388 | A | 7/1985 | Sackmann et al. |
| 4,858,361 | A | 8/1989 | White |
| 4,934,085 | A | 6/1990 | Lough |
| 5,198,600 | A | 3/1993 | E'Nama |
| 5,279,060 | A | 1/1994 | Watson |
| 5,400,540 | A | 3/1995 | Solinsky et al. |
| 5,403,980 | A | 4/1995 | Eckrich |
| 5,570,529 | A | 11/1996 | Amelino |
| 5,590,484 | A | 1/1997 | Mooney et al. |
| 5,642,932 | A | 7/1997 | Matthews |
| 5,654,594 | A | 8/1997 | Bjornsen, III et al. |
| 5,826,363 | A | 10/1998 | Olson |
| 5,878,503 | A | 3/1999 | Howe et al. |
| 5,941,489 | A | 8/1999 | Fanelli et al. |
| 6,014,830 | A | 1/2000 | Brown et al. |
| 6,230,431 | B1 | 5/2001 | Bear |
| 6,276,088 | B1 | 8/2001 | Matthews et al. |
| 6,345,464 | B1 | 2/2002 | Kim et al. |
| 6,385,894 | B1 | 5/2002 | Podvin |
| 6,418,657 | B1 | 7/2002 | Brown |
| 6,421,946 | B1 | 7/2002 | LoRocco |
| 6,446,377 | B1 | 9/2002 | Hollenbach et al. |

(Continued)

OTHER PUBLICATIONS

United States Department of Defense, Military Standard: Dimensioning of Accesory Mounting Rail for Small Arms Weapons, MIL-STD-1913, Feb. 3, 1995.

(Continued)

*Primary Examiner*—Bao Q Truong
(74) *Attorney, Agent, or Firm*—David Weiss

(57) ABSTRACT

A switch device for an electrical appliance securable to a rail structure, a preferred embodiment of the switch device including a remote switch including a resilient or flexible housing having resilient members adapted to grasp a longitudinal rail of the rail structure for retaining the housing to the rail.

19 Claims, 3 Drawing Sheets

U.S. PATENT DOCUMENTS

| | | | |
|---|---|---|---|
| 6,449,893 | B2 | 9/2002 | Spinner |
| 6,568,118 | B1 | 5/2003 | Teetzel |
| 6,608,264 | B1 | 8/2003 | Fouladpour |
| 6,609,321 | B2 | 8/2003 | Faifer |
| 6,609,810 | B2 | 8/2003 | Kim |
| 6,615,531 | B1 | 9/2003 | Holmberg |
| 6,655,069 | B2 | 12/2003 | Kim |
| 6,725,594 | B2 | 4/2004 | Hines |
| 6,851,214 | B2 | 2/2005 | Oz |
| 7,332,682 | B2 * | 2/2008 | Kim ..... 200/18 |

OTHER PUBLICATIONS

SureFire, "2002 Surefire Weaponlight Catalog", pp. 34, 37, 48, 49, 52 and 53, published 2002.
Insight Technology, "M3X Operator's Manual" (24 pages), dated Jul. 2, 2003.
SureFire, "2002 Surefire Weaponlight Catalog", pp. 34, 37, 48, 49, 52 and 53, published 2002.

* cited by examiner

SWITCHES FOR ELECTRICAL ACCESSORIES

CROSS REFERENCE TO RELATED APPLICATION

This application is a division of U.S. patent application Ser. No. 10/835,960 filed Apr. 29, 2004 now U.S. Pat. No. 7,273,292, which application is incorporated herein by reference.

BACKGROUND OF THE INVENTION

This invention relates to switchable electrical accessory apparatus including light beam generator apparatus for firearms and other guns, and more particularly to removably securable switching devices for such apparatus.

Switchable electrical accessory apparatus including light beam generators, such as flashlights and laser aiming devices, have been adapted for being secured to firearms as target illuminators and laser sights. Such light beam generators are mounted to the firearm such that the generated light beam is parallel and preferably close to the longitudinal axis of the firearm's barrel.

Such accessories including light beam generators are conventionally equipped with a mounting device for releasably securing the accessory to a rail mount structure secured to the firearm. Such accessory mounts and rail structures may include rail interface systems well known in the art pertaining to firearms, and in particular with respect to submachine guns, carbines, rifles, shotguns and other firearms including handguns used for military and law enforcement operations.

Various types of switch apparatus are known for firearm-mounted light beam generators, including pushbutton actuated tail cap switches with CONSTANT ON and MOMENTARY ON capabilities, and pressure actuable MOMENTARY ON tape switches. Different tactical situations and operator personal preferences often direct the selection of particular switch types.

SUMMARY OF THE INVENTION

The present invention provides switch devices for electrical accessory apparatus for firearms, including light beam generator apparatus mountable to firearms including rail mount structures secured to firearms. According to a preferred embodiment of the present invention, a removably securable tail cap assembly for a light beam generator includes a jack, while a remote switch connected by a cable to a plug is removably connectable to the tail cap jack.

Another preferred embodiment of the tail cap assembly includes a pushbutton switch in addition to the jack for the remote switch. In a preferred embodiment of a remote switch for use with an electrical accessory, a tape switch is contained in a flexible housing that is removably securable to a rail of a rail mount structure secured to a firearm.

According to one aspect of the present invention, there is provided a light beam generator apparatus comprising in combination: a battery housing; a light emitter assembly carried by the battery housing; a battery carried by the battery housing in circuit for energizing the light emitter assembly when switch actuated; a switch device including a remote switch, a first connector device, and a cable conductively connecting the remote switch to the first connector device; and a tail cap assembly removably secured to the battery housing and including a second connector device complementary to the first connector device for removably connecting the first connector device to the tail cap assembly with the remote switch in circuit with the battery. Preferably, the first connector device comprises a plug and the second connector device comprises a jack, and the remote switch is a momentary tape switch.

According to another aspect of the invention, the tail cap assembly further includes a tail cap switch in circuit with the battery for energizing the light emitter assembly when actuated, the tail cap assembly including an actuator for the tail cap switch. Preferably, the actuator for the tail cap switch comprises a pushbutton actuator, and the tail cap switch is actuable by the pushbutton actuator for placing the tail cap switch in a CONSTANT ON or OFF position, and/or may be actuable for placing the tail cap switch in a MOMENTARY ON position. In a preferred embodiment of such tail cap assembly, the jack and the pushbutton actuator are offset from the tail cap assembly's longitudinal axis, and the tail cap assembly is rotatably urgeable about such axis.

The remote tape switch, for use with any of these tail cap assembly embodiments, may be contained in a preferably flexible switch housing adapted to be removably secured to a longitudinal rail of a rail mount structure for a firearm.

In accordance with a preferred embodiment of yet another aspect of the present invention, there is provided a switch device for use with an electrical accessory securable to a rail structure, the switch device comprising: a switch; a housing for the switch, such housing including longitudinally extending resilient flanges adapted to engage a longitudinal rail of the rail structure for transversely retaining the housing to the rail. The switch housing preferably includes at least one lug for being received by at least one space between two adjacent transverse ribs of the rail of the rail structure, for longitudinally retaining the housing to the rail.

The remote switch housing is preferably resilient, and the switch preferably comprises a tape switch. Tactile indicia may be provided on the housing for indicating to an operator a pressure actuable portion of the tape switch.

The switch device preferably includes a first connector (such as a plug) adapted for being electrically connected to a complementary second connector (such as a jack) of the electrical accessory; and a cable electrically connecting the switch to the plug.

BRIEF DESCRIPTION OF THE DRAWINGS

The novel features believed to be characteristic of the present invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
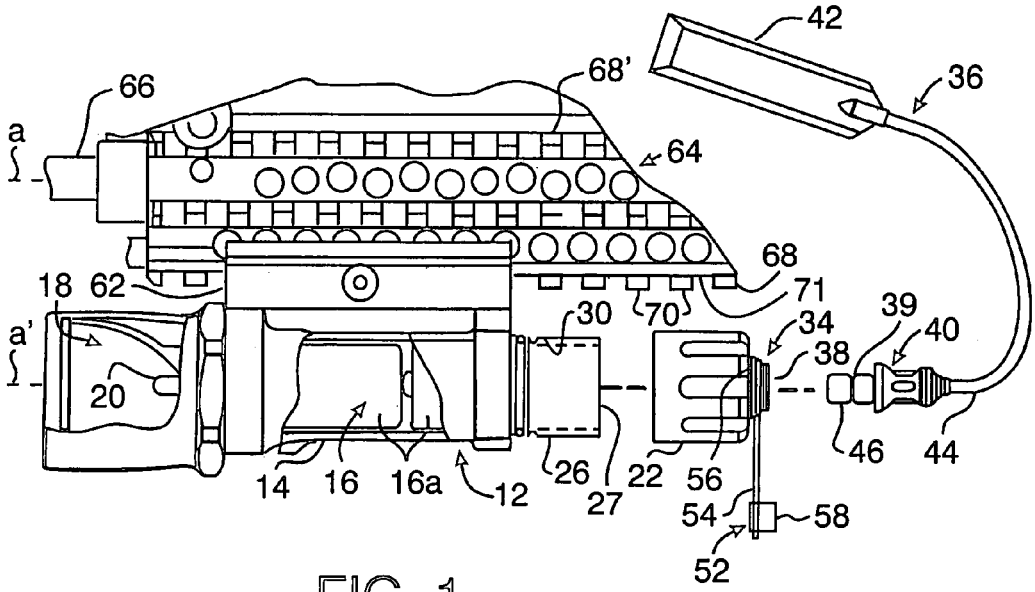
FIG. 1 is an exploded side view (partly broken away) of a light beam generator apparatus, specifically a target illuminator or flashlight secured to a fragment of an accessory mount rail structure for a firearm, including a rear or tail cap assembly and detachable tape switch device according to a preferred embodiment of the present invention.
Figure 2:
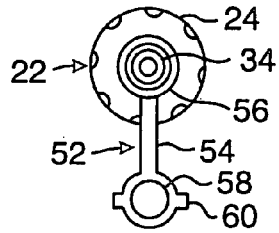
FIG. 2 is a rear view of the tail cap shown in the FIG. 1.
Figure 3:
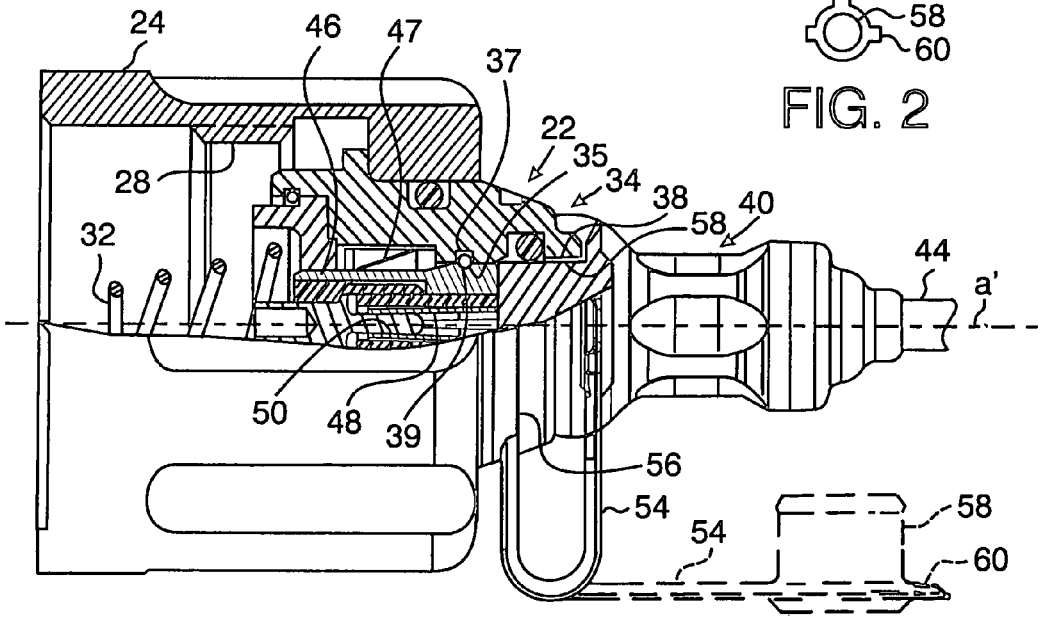
FIG. 3 is a side view of the tail cap of FIG. 1, partly broken away, connected to a preferred configuration of the detachable connector device of the tape switch shown in FIG. 1.

Turning to FIGS. 1-3, there is illustrated an example of a light beam generator 12, such as a flashlight or target illuminator for a firearm, including a generally cylindrical battery housing 14 in which is contained a power source such as a battery 16 comprising one or more battery cells 16*a* (for example, two three-volt lithium battery cells 16*a*). A light emitter assembly 18 includes a light emitter 20, such as an incandescent light bulb or a high luminous flux light emitting diode, in electrical circuit with the battery 16.

A tail cap assembly 22 includes a tail cap 24 which is removably secured to the rear end portion 26 of the battery housing 14, such as by tail cap internal threads 28 threadably securable to housing rear end portion external threads 30. When the tail cap assembly 24 is secured to the battery housing 14, a spring contact 32 included in the tail cap assembly 22 conductively engages the rear terminal of the battery 16. The battery spring contact 32 is conductively secured to a normally open circuit connector device or jack 34 to which a switch device 36 may be connected for selectively closing the circuit to cause the light emitter 20 of the light emitter assembly 18 to be energized by the battery 16. The connector device 34 is retained by the tail cap 24 and includes a rear opening 38 for receiving and detachably retaining a complementary connector device or plug 40 of the switch device 36.

In the preferred embodiment, the jack 34 includes a spring detent 35 in an internally circumferential groove 37, for entering a circumferential groove 39 in the plug 40 to retain the plug 40 in the jack 34 when the plug 40 is forwardly pushed into the jack 34 and to release the plug 40 from the jack 34 when the plug 40 is rearwardly pulled from the jack 34.

The attachable/detachable switch device 36 includes a remote switch 42, such as a momentary switch preferably provided by a type of switch commonly known as a tape switch. Tape switches are well known in the art, and their construction typically includes spaced electrodes in a flexible enclosure to which pressure may be manually applied by an operator for squeezing the electrodes together thereby bringing them into electrical contact with each other. The electrodes assume their spaced condition when the operator discontinues the application of such pressure. Tape switches used with light beam generator apparatus removably attachable to firearms are described in U.S. Pat. No. 5,654,594 issued to Bernie E. Bjornsen, III, Peter Hauk and John W. Matthews and assigned to the assignee of the present invention, and in U.S. Pat. No. 6,276,088 issued to John W. Matthews and Paul Y. Kim and assigned to the assignee of the present invention, which patents are incorporated herein by reference.

The attachable/detachable switch device 36 includes a preferably flexible cable 44 having two conductors connecting the two electrodes of the tape switch 42 to two conductive contacts of the plug 40. One of the plug contacts is provided by the outer substantially cylindrical longitudinal conductive sheath 46 which, when inserted through the opening 38 of the jack 34, completes a conductive path to one electrode terminal of the light emitter; for example, the outer plug contact 46 engages jack spring contact 47 which is conductively coupled to the conductive battery housing 14, such terminal of the light emitter 20 also being conductively coupled to the battery housing 14.

The other plug contact is provided by the inner longitudinal conductive sheath 48 in contact engagement with a longitudinal conductive pin 50 of the jack 34, which pin contact 50 is conductively secured to the battery spring contact 32 which in turn is in contact engagement with the rear terminal of the battery 16. Since the other terminal of the battery 16 is conductively coupled to the other terminal of the light emitter 20 in conventional manner, the remote switch 42 is in circuit with the battery 16 for energizing the light emitter assembly 18 upon actuation of the remote switch 42 while the plug 40 is connectively inserted to the jack 34.

It may be appreciated that the detachable/attachable capability of the switch device 36 facilitates field replaceability of damaged tape switches 42 and cables 44, as well as for connecting different types of remote switches. Further, switch devices may be provided with cables 44 of different lengths, so that an operator may select a switch device 36 with a cable of a particular length as may best suit a particular tactical situation.

The tail cap assembly 22 preferably includes a cover 52 for closing the tail cap's rear opening 38 when the plug 40 is removed from the jack 34. The cover 52 may be fabricated (such as by molding) of a plastic material, and the preferred embodiment thereof includes a flexible band 54 with a ring 56 at one end secured to the jack 34 and encircling the opening 38, and with a solid plug or cap 58 at the flexible band's free end configured for friction-fit insertion into the rear opening 38. It is noted that FIG. 3 shows the cover 52 in solid line representation, with the cover cap 58 installed in the rear opening 38 as if the plug 40 were also inserted in the opening 38. Of course, in actuality, the cap 58 is not inserted in the opening 38 when the plug 40 is inserted; in actuality, when the plug 40 is inserted in the opening 38, the cover 52 is as shown by the dotted line representation in FIG. 3 (or as shown in FIGS. 1 and 2).

The cover 52 may include radial projections or appendages 60 about the cap 58, which may be manipulated by an operator for removing the cap 58 from the rear opening 38.

As illustrated in FIG. 1, the preferred embodiment of the light beam generator 12 is equipped with a mounting device 62 secured to the battery housing 14, for releasably securing the light beam generator 12 to a rail mount structure 64 secured to a firearm represented by the firearm's barrel 66 having a longitudinal axis a, with the light beam generator's longitudinal axis a' parallel to the barrel axis a.

The mounting device 62 may include a Weaver style or other clamping device for mounting to a rail 68 of the rail structure 64. Such rail mount structure may be of a type well known in the firearms art for mounting accessories including light beam generators to a firearm. Examples of such rails for accessory mounts are provided by rail interface system devices such as manufactured by Knights Manufacturing Company (of Vero Beach, Fla.), including those disclosed in U.S. Pat. No. 5,826,363 of Douglas D. Olson, as well as those disclosed in U.S. Pat. No. 5,590,484 of Aurelius A. Mooney et al., and those disclosed in U.S. Pat. No. 6,655,069 of Paul Y. Kim, each of which patents are incorporated herein by reference.

One such prior-art rail comprises a series of longitudinally spaced-apart ribs 70 as specified in MIL-STD-1913, commonly known as a Picatinny rail and shown in FIG. 1 as a bottom rail comprising the spaced-apart ribs 70. Side and top Picatinny rails are commonly included in such rail mount structure 64; a modified Picatinny side rail 68' is shown in FIG. 1, which modified Picatinny rail 68' is described in the aforementioned Kim U.S. Pat. No. 6,655,069.

Figure 4:
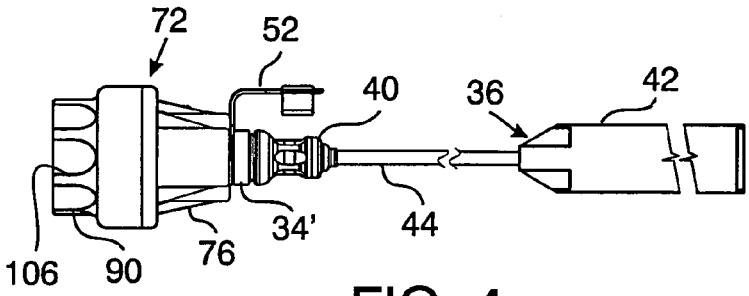
FIG. 4 is a side view of a second preferred embodiment of a rear or tail cap assembly connected to the detachable tape switch device as in FIG. 1.
Figure 5:
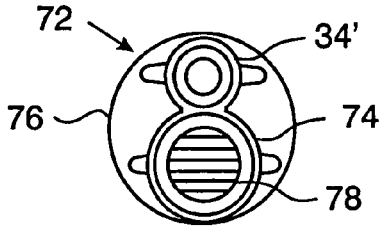
FIG. 5 is a rear view of the tail cap assembly of FIG. 4.
Figure 6:
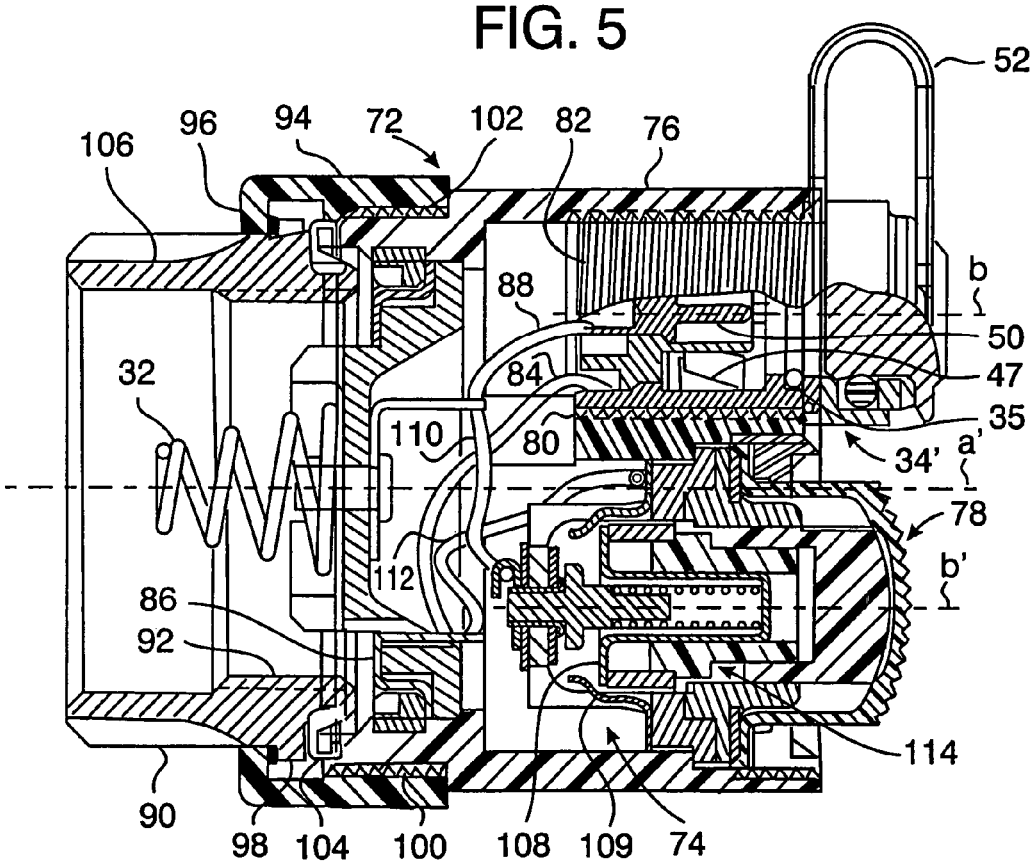
FIG. 6 is a longitudinal cross-sectional view of the tail cap assembly shown in FIG. 4.
Figure 7:
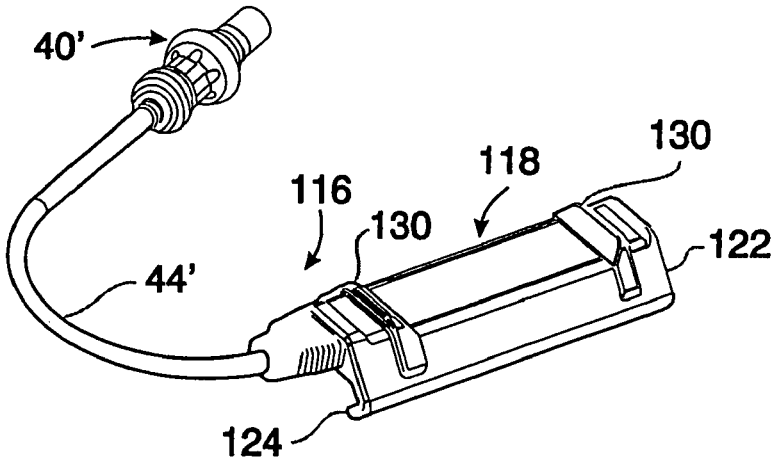
FIG. 7 is a perspective view of an alternative embodiment of a detachable tape switch device for use with the tail cap assemblies of FIGS. 1-6, such tape switch device being removably mountable on a rail of a rail structure as in FIG. 1.

Turning to FIGS. 4-6, the tail cap assembly 72 of the second preferred embodiment according to the present invention includes a connector device or jack 34' corresponding to the connector or jack 34 of FIGS. 1-3, to which the tape switch 42 of the switch device 36 may be connected via the connector device or plug 40 in the same manner as previously described. In addition, however, the tail cap assembly 72 further includes a second switch 74 secured in the tail cap 76 in circuit with the battery 16 in the battery housing 14, for energizing the light emitter 20 of the light emitter assembly 18 when actuated. The actuator for the tail cap switch 74 is included in the tail cap assembly 72, a preferred embodiment of which is a pushbutton actuator 78 carried by the tail cap 76.

The longitudinal axis b of the jack 34' and the longitudinal axis b' of the tail cap switch 74 are offset from the longitudinal axis a' along a diameter of the tail cap 76. The tail cap 76 is preferably fabricated of a non-conductive material, such as a polymer, and includes an internally threaded longitudinal compartment 80 for threadably securing a conductive metal cylindrical shell 82 retaining and securing the jack 34' to the tail cap 76. Conductive wire 84 provides a conductive path between the conductive shell 82 and a spring washer contact 86 which is in conductive engagement with the rear end portion 26 of the battery housing 14 when the tail cap assembly 72 is secured to the battery housing. Conductive wire 88 conductively connects the axial pin contact 50 of the jack 34' to the battery spring contact 32.

The tail cap assembly 72 includes a conductive sleeve 90 (e.g. fabricated of a metal such as aluminum), including internal threads 92 for threadably securing the sleeve 90 to the externally threaded rear end portion 26 of the battery housing 14 until the battery housing's rear edge 27 contacts the spring contact washer 86. A ring 94 (preferably of a polymer material) having an inwardly directed lip 96 is longitudinally retained by a collar 98 extending about the sleeve 90, the ring 94 including internal threads 100 mating with external threads 102 of the tail cap 76 threadedly securing the ring 94 to the tail cap 76. Accordingly, the tail cap 76 and ring 94 combination is longitudinally secured to the sleeve 90 and is rotatable with respect to the sleeve 90 (and hence with respect to the battery housing 14) about the longitudinal axis a'. Resistance to such rotation may be provided by an elastomeric gasket 104 (e.g., of neoprene) retained by the forward edge of the tail cap 76 and contacting the rearward edge of the metal sleeve 90.

Such resistive rotation of the tail cap 76 with respect to the sleeve 90 secured to the battery housing 14 permits an operator to rotationally adjust the position of the offset pushbutton switch 74 for convenience of use. Such positioning may be conveniently performed after the light beam generator 12 with secured tail cap assembly 72 has been mounted to firearm 66 (FIG. 1). The operator may simply rotatably urge the ring 94 (secured to the tail cap 76) with one hand, while with the other hand holding the sleeve 90 against rotation utilizing the finger grips 106 as convenient.

Tail cap switches of the pushbutton type are well known in the flashlight art, any of which pushbutton switches may be utilized in the tail cap assembly 72 of the present invention. An example of such a pushbutton switch is described in U.S. Pat. No. 5,642,932 of John W. Matthews, which patent is incorporated herein by reference. Another example of a pushbutton switch is of a CONSTANT ON/OFF type where one depression of the pushbutton 78 completes and maintains the circuit for causing the battery 16 to energize the light emitter 20, and a succeeding depression of the pushbutton 78 opens the circuit such that the lamp 20 is no longer energized by the battery 16. The pushbutton switch may also include a MOMENTARY ON position, where a partial depression of the pushbutton 78 causes the circuit to be completed for energizing the light emitter 20 for as long such partial depression is maintained.

As illustrated in FIG. 6, depression of the pushbutton 78 causes the plunger contact 108, which is conductively coupled to the battery spring contact 32 (via conductive wire 110), to conductively engage spring contact 109 which is conductively coupled to the spring washer contact 86 (via conductive wire 112). Since the spring washer contact 86 is conductively coupled to the conductive battery housing 14 when the tail cap assembly 72 is secured to the battery housing 14, the circuit is thereby completed for energizing the light emitter 20 by the battery 16. Plunger camming arrangements on the plunger device 114, of the type shown in the pushbutton switch arrangement disclosed in U.S. Pat. No. 4,319,106 issued to Ralph T. Armitage, which patent is incorporated herein by reference, may be utilized for effecting the CONSTANT ON and OFF switch positions when the pushbutton 78 is fully depressed, and the MOMENTARY ON position when the pushbutton 78 is partially depressed.

FIGS. 7-10 illustrate a second preferred embodiment of an attachable/detachable remote switch device 116, for use with the tail cap assemblies 22 and 72 of FIGS. 1-6. In the switch device 116, the pressure actuable tape switch 118 includes squeezable-together tape switch electrodes 120 enclosed within a flexible housing 122 adapted for being attached to and detached from a rail 68 or 68' of a rail mount structure 64 secured to a firearm 66 as represented in FIG. 1.

The remote switch connector or plug 40' is preferably identical or similar to the remote switch connector or plug 40 shown in FIGS. 1 and 3 and previously described. The cable 44', which may be identical or similar to the cable 44 of FIG. 1, conductively couples the plug contacts 46, 48 (FIG. 3) of the plug 40' to the tape switch electrodes 120 situated within the flexible housing 122.

The tape switch housing 122, which is preferably fabricated (such as by molding) of an elastomeric material such as neoprene, is configured to transversely extend across at least two and preferably seven of the longitudinally spaced-apart ribs 70 of the rail 68 (or 68') while resiliently grasping such rail along its longitudinal dimension. For example, in the preferred embodiment shown in FIGS. 7-10, the tape switch housing 122 includes inwardly inclined resilient flanges 124 longitudinally extending along the two respective sides of the housing 122, for grasping the inwardly inclined longitudinal surfaces 126 of the rail 68, thereby transversely retaining the tape switch housing 122 to the rail 68.

Figure 8:
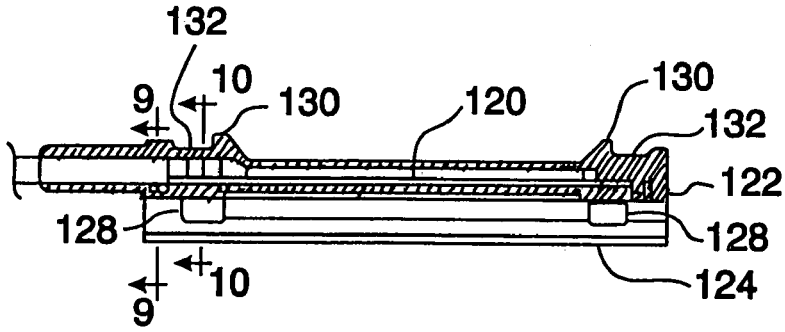
FIG. 8 is a longitudinal cross-sectional view of the rail mountable tape switch device of FIG. 7.
Figure 9:
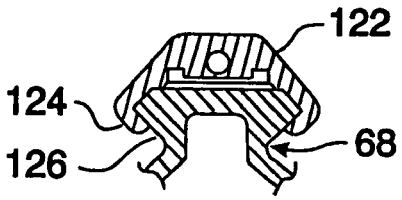
FIG. 9 is a transverse cross-sectional view of the tape switch housing shown in FIGS. 7 and 8 mounted to a rail of a rail structure as shown in FIG. 1, the tape switch housing portion of FIG. 9 taken along the line 9-9 of FIG. 8 and viewed in the direction of the appended arrows.
Figure 10:
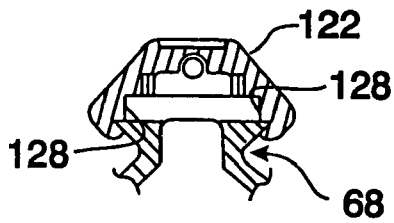
FIG. 10 is a transverse cross-sectional view of the tape switch housing shown in FIGS. 7 and 8 mounted to a rail of a rail structure as shown in FIG. 1, the tape switch housing portion of FIG. 10 taken along the line 10-10 of FIG. 8 and viewed in the direction of the appended arrows.

The tape switch housing 122 is further configured with at least one transverse protrusion or lug 128, preferably resilient, for being received by at least one space 71 between adjacent ribs 70 (see FIGS. 1 and 10). In the preferred tape switch housing 122, there are provided two such lugs 128 inwardly extending from each longitudinal side of the housing 122, preferably longitudinally spaced apart so as to be situated near the front and rear ends thereof (FIG. 8).

The tape switch housing 122 may include tactile indicia indicating the pressure actuable portion of the tape switch 118, such as raised transverse boundaries or bars 130 longitudinally separated by the active or pressure sensitive length of the tape switch electrodes 120, for indicating to an operator the proper place to which pressure should be applied for operating the momentary tape switch 118. The housing 122 may also be provided with transverse grooves 132 in the vicinity of the housing's front and rear ends, for facilitating the application of flexible ties to further secure the tape switch 118 to the rail structure 64 or to another object if desired.

It may be appreciated that the rail attachable/detachable momentary tape switch 118 of the present invention may be removably secured to any one of the rails of an accessory mount rail structure as may be convenient to the operator, as well as at any place along such rail as may be convenient; for example, the tape switch 118 may be removably installed anywhere along a bottom rail, a side rail or a top rail of a rail structure such as rail structure 64. Further, the rail attachable/detachable tape switch 118 may be removably secured to the same rail to which a switchable electrical accessory (such as the light beam generator 12) is secured, or the switch 118 may be attached to a rail other than the rail to which the accessory or light beam generator is secured.

The tape switch 118 may be secured to a rail by placing the switch housing 120 to the rail with one of the longitudinally extending resilient flanges 124 in contact with one of the inclined longitudinal surfaces 126 of the rail and with the lugs 128 along such secured flange 124 situated in corresponding spaces 71. The operator then pivots the tape switch housing 122 across the rail while outwardly urging the other resilient flange 124 and then releasing such other resilient flange 124 for permitting the flanges 124 to grasp the other rail surface 126. The secured tape switch 118 may be removed from the rail by outwardly urging one of the resilient flanges 124 away from its engaged rail surface 126 until such flange 124 is disengaged from such surface 126, and then withdrawing the switch housing 122 from the rail.

Although a flashlight or target illuminator embodiment of the light beam generator is specifically described above, laser aiming devices securable to firearms, or to rails carried by firearms, are included within the scope of light beam generators according to the present invention.

Thus, there have been described various embodiments of switch devices for electrical accessory apparatus for a firearm, and in particular for a light beam generator apparatus for a firearm, including a rail-attachable remote switch device. Other embodiments of the present invention, and variations of the embodiments presented herein, may be developed without departing from the essential characteristics thereof. Accordingly, the invention should be limited only by the scope of the claims listed below.

I claim:

1. A switch device for an electrical accessory securable to a rail structure carried by a firearm, the switch device comprising:

a remote switch including a housing, said housing including resilient members adapted to grasp a longitudinal rail of the rail structure for removably retaining said housing to the rail.

2. The switch device according to claim 1, wherein:

said housing comprises a flexible housing.

3. The switch device according to claim 2, wherein:

said remote switch comprises a tape switch.

4. The switch device according to claim 3, including:

tactile indicia on said housing indicating a pressure actuable portion of said tape switch.

5. The switch device according to claim 1, wherein:

said resilient members comprise longitudinally extending flanges for transversely retaining said housing to the rail.

6. The switch device according to claim 1, the rail including longitudinally spaced-apart transverse ribs, wherein:

said housing includes at least one lug for being received by at least one space between two adjacent ones of the ribs for longitudinally retaining said housing to the rail.

7. The switch device according to claim 6, wherein:

said at least one lug comprises at least one resilient lug.

8. The switch device according to claim 7, wherein:

said housing comprises a flexible housing.

9. The switch device according to claim 8, wherein:

said remote switch comprises a tape switch.

10. The switch device according to claim 1, including:

a first connector adapted for being electrically connected to a complementary second connector of the electrical accessory; and a cable electrically coupling said switch to said first connector.

11. The switch device according to claim 10, wherein:

said first connector comprises a plug and the complementary second connector comprises a jack.

12. The switch device according to claim 10, wherein:

said housing comprises a flexible housing.

13. The switch device according to claim 12, wherein:

said remote switch comprises a tape switch.

14. The switch device according to claim 13, including:

tactile indicia on said housing indicating a pressure actuable portion of said tape switch.

15. The switch device according to claim 10, wherein:

said resilient members include longitudinally extending flanges for transversely retaining said housing to the rail.

16. The switch device according to claim 15, the rail including longitudinally spaced-apart transverse ribs, wherein:

said housing includes at least one lug for being received by at least one space between two adjacent ones of the ribs for longitudinally retaining said housing to the rail.

17. The switch device according to claim 16, wherein:

said at least one lug comprises at least one resilient lug.

18. The switch device according to claim 17, wherein:

said housing comprises a flexible housing.

19. The switch device according to claim 18, wherein:

said remote switch comprises a tape switch.

* * * * *